United States Patent [19]

Pavel

[11] Patent Number: 4,541,470

[45] Date of Patent: Sep. 17, 1985

[54] METHOD OF PRODUCING SEWING MACHINE NEEDLES

[75] Inventor: Klaus Pavel, Eynatten, Belgium

[73] Assignee: Rhein-Nadel Maschinennadel GmbH, Aachen, Fed. Rep. of Germany

[21] Appl. No.: 528,701

[22] Filed: Sep. 1, 1983

[30] Foreign Application Priority Data

Sep. 23, 1982 [DE] Fed. Rep. of Germany ..... 3235154

[51] Int. Cl.[4] ..... B21G 1/02

[52] U.S. Cl. ..... 163/5

[58] Field of Search ..... 163/1-5

[56] References Cited

U.S. PATENT DOCUMENTS 1,259,982 3/1918 Heusch ..... 163/1

4,037,641 7/1977 Zocher ..... 163/5

*Primary Examiner*—Howard N. Goldberg

*Assistant Examiner*—Timothy V. Eley

*Attorney, Agent, or Firm*—Martin A. Farber

[57] ABSTRACT

A method of manufacturing sewing machine needles from a cylindrical length of wire by compression molding, comprising the steps of selecting the length of the wire substantially corresponding to two of the needles to be manufactured and a diameter of the wire corresponding to the thickness of a butt of the needles to be manufactured, the length being equal substantially to two coaxial connected needle blanks of one-piece for the needles to be manufactured, simultaneously working the two needle blanks to form the two needles, with the two needle blanks being worked such that the butts respectively face each other, by the steps of forming the blanks approximately to a final cross-sectional dimension of the two needles to be manufactured over their shanks and sections between the butts and shanks while leaving the butts of the two needles facing each other back to back and pressing grooves in the wire from transversely convexly curved outer surfaces of the wire within a region of the shanks, while simultaneously effecting the cross-sectional reduction by pressing opposite portions of the blanks at the shanks so as to form laterally projecting flat fins which leave therebetween the transversely convexly curved outer surfaces of reduced diameter substantially with the final diameter, and removing the flat fins in a subsequent step.

19 Claims, 11 Drawing Figures

METHOD OF PRODUCING SEWING MACHINE NEEDLES

BACKGROUND OF THE INVENTION

The invention refers to a method of producing sewing machine needles in general.

Particularly the invention refers to a method of producing sewing machine needles from a cylindrical length of wire.

The present invention uses die pressing, namely compression molding in which, starting from a diameter of the length of wire corresponding to the thickness of the needle butts, the length of wire is reduced approximately to the final cross-sectional size over at least the length of the needle shank and of a section and, furthermore, in the region of the needle shank, thread grooves are pressed in from the curved outer surfaces of the length of wire, the reduction in cross section being effected by pressing opposite portions of wire material so as to form laterally projecting flat fins which leave between them the transversely convexly curved outer surfaces which are in the final diameter, the flat fins being removed in a subsequent step, and with two coaxially oriented needle blnaks being worked simultaneously.

This compression molding from the solid blank represents a clear advance in manufacture as compared with the convectional, frequently time-consuming method of reduction by rotary press, since almost the complete final contour of the needle is obtained in a manner which is gentle to the structure and in a single working stroke.

The object of the present invention is to use and to further enhance this basic method of the invention such that on the one hand there is a stable double-needle blank, and on the other hand, however, the critical point region will be held as free of stress as possible. In particular, the pointing can be carried out more favorably.

SUMMARY OF THE INVENTION

This object is achieved in accordance with the invention in advantageous manner with a method of the type set forth above in such manner that the two needle blanks are turned with their butts toward each other.

While maintaining the proven method of manufacturing sewing machine needles from a cylindrical length of wire by compression molding, a still more favorable way is found for the automatic manufacture due to following additional measure: The facing butts form a highly stable, central piece, the formation taking place near the free ends of the length of wire which forms the starting material. The flat fins border the two points of the double-needle blank up to the very end. The points become free only upon the final separation of the flat fins. They then project free for the subsequent pointing without the separation of the double-needle blank being necessary; rather, the double-needle blank is maintained up to the last as a relatively large piece of material. It is furthermore advantageous for the end surfaces of the butts to lie on a common cross-sectional plane. The separation is carried out very simply. the problem of separation in the region of the weaker ends of the points does not arise. The form of the notch itself can furthermore be used for precise alignment of the blank for the compression molding. Moreover, it forms at the same time the chamfer of both butt heads.

BRIEF DESCRIPTION OF THE DRAWING

Further advantages and details of the method are described in further detail below with reference to an embodiment shown in the drawing, in which.

DESCRIPTION OF THE PREFERRED EMBODIMENTS

Figures 1, 2, 3, 4, 5, 6, 7, 8, 9, 10, 11:
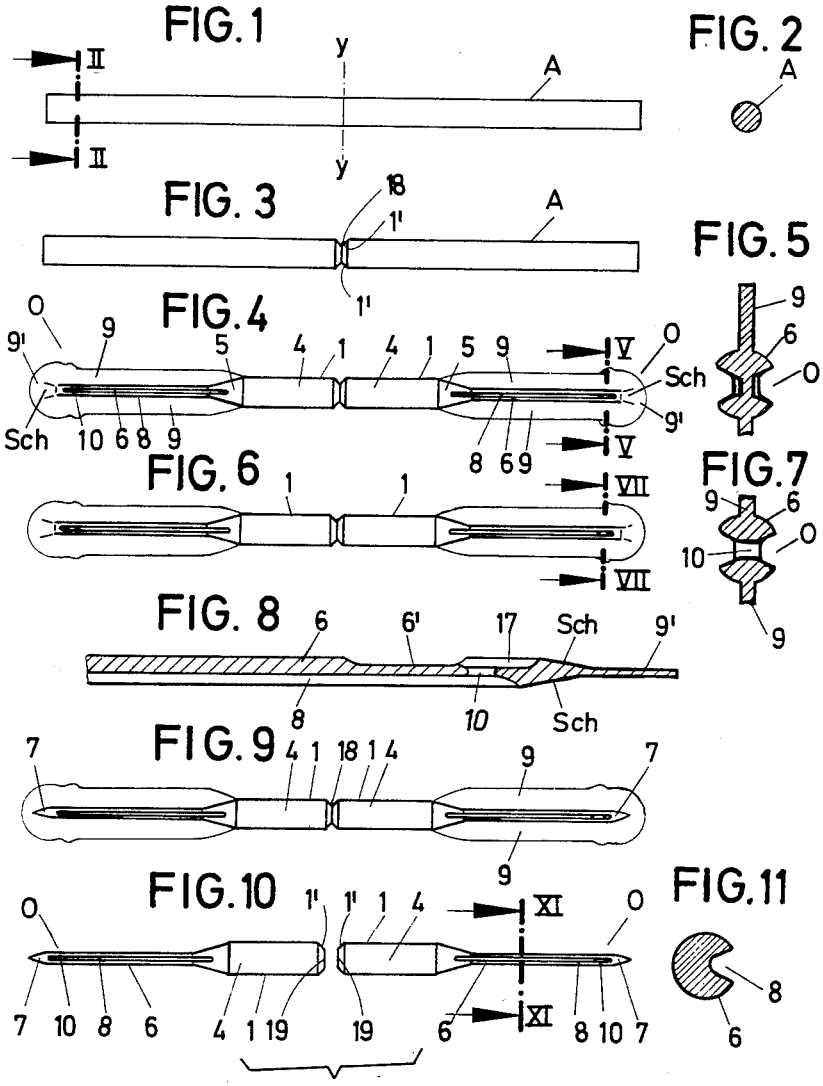
FIG. 1 shows the piece of wire, having a length of two finished needles, which forms the starting material, seen in side view on an enlarged scale.
FIG. 2 is a section along the line II—II of FIG. 1.
FIG. 3 shows in side view the length of wire with the transverse notch which determines the cross-sectional plane.
FIG. 4 shows in side view the double-needle blank after the compression molding with clear indication of the needle butts lying back to back.
FIG. 5 shows a section along line V—V in FIG. 4 on an even larger scale.
FIG. 6 is a view corresponding to FIG. 4, but after the punching of the needle eye.
FIG. 7 is a section along the line VII—VII of FIG. 6.
FIG. 8 is a partially broken-away longitudinal section in the region of one of the points of the double-needle blank lying at the end, again on a larger scale.
FIG. 9 shows in side view the so-called pointing of the double-needle blank.
FIG. 10 shows in side view the double-needle blank after the trimming and separation.
FIG. 11 is a section along the line XI—XI of FIG. 10.

The blank for the manufacture of sewing machine needles is formed from a cut section of wire A. The latter has a circular cross section. Its diameter corresponds essentially to that of the cylindrical needle butt of the finished product.

The total length of the length of wire A corresponds to the material required for the simultaneous manufacture of two sewing machine needles.

The pressing tool consisting of upper and lower dies (not shown) is so arranged that the butts 1 of the double-needle blank which are to be formed lie back to back. The plane of the separation cut to be effected later is indicated in FIG. 1 with y—y. It is so located that needles of the same length can be produced. This does not rule out, naturally, that also needles of different lengths can be produced using the same method.

For the marking of the separation cut-plane y—y the length of wire is notched on its circumference. The transverse notch is indicated as 18. The flanks of the notch have an angle which corresponds to that of the usual chamfer formation of the butt. The chamfer is indicated as 1'.

The length of wire A prepared in this manner is placed into the pressing tool. The latter is so equipped that except for punching of the eye O, practically the final form of the needle can be produced with one pressing stroke. The double-needle blank then is formed in the region of its butts 1, which are located back to back, with the usual flattening 4 as well as an adjoining frustoconical section 5. The base of the frustum corresponds to the shape of the cross-section of the butt. The tapered-down section of each of the frustums 5 continues into a needle shank 6 which in turn passes finally into the point region or the so-called eye O.

The needle shank 6, seen in cross section, assumes approximately the shape of a U or V profile as a result of the simultaneous embossing of a needle groove 8 extending from the section 5 up to the region of the point (see FIG. 11).

The material of the blank which is displaced due to the reduction of cross section and formation of the groove passes out through a tool slot left on both sides between the upper and lower die of the pressing tool. The flat fins which are formed in the process are designated as 9. Their width depends on the volume displaced. Less material is displaced in the region of the section 5 than in the region of the point.

The flat fins 9 provide an advantageous flat strip type widening of the blank in the region of the shanks 6 which have a relatively small cross section and of the points which is advantageous for the next production step. The lateral flat fins also surround the already preformed or completely formed points 7 of the double-needle blank. They have the shape of an essentially rounded flat-fin section 9' running around the point 7 in the same plane.

The shaping of the double-needle blank goes beyond the development explained to the extent that in the region of the eye "O" before the latter is punched, a so-called fillet 6' was also pressed, which fillet extends on the side of the needle shank 6 opposite the needle groove 8. In addition, also simultaneously formed was a so-called short groove 17 (see FIG. 8). The eye itself however, is not yet punched. It is only pre-embossed and indicated as a needle eye 10 in FIG. 4 for easy understanding. The depth of the prestampings produced on both sides of the needle body and aligned with the course of the grooves 8, 17 can be noted from FIG. 5.

In the next processing station, after the centering of the double-needle blank, which can be carried out precisely due to the flat fins 9 which can be used advantageously for this and also due to the notch 18, there now follows the stamping of the needle eye 10 in the region of the ends. The needles are still connected near the butts and the needle shanks are stabilized by the flat fins 9.

The previous compression molding operation flattened the point region, starting from the general diameter of the shank, into a knife shape. There was thus produced a bevel Sch forming a wedge shape which sloped down toward the ends on both sides in the shape of a roof.

At the same time as the stamping of the needle eye 10, or else at an additional station of a follow-on, the so-called dimpling is effected. There is meant by this the rounding of the upper and lower edges of the needle eye 10. For this purpose, the needle blank is turned 180° around its axis. The turned position can be noted from FIG. 8.

In another station, or at the same time, the pointing of the needle blank can be carried out. By this the needle point 7 is practically given its final shape, as can be noted from FIG. 10. With due consideration of the knife-shaped bevel Sch which converges toward the forward region of the tip and is already present, there is now effected also a two-sided beveling in the vertical so that as a whole an approximately pyramidal point is produced. The last-mentioned shaping can, however, also take place at the same time as the cutting and separation of the double-needle body. The two needle blanks which have been separated along the vertex of the notch 18 are thereupon introduced into further treatment phases, i.e. final pointing, heat treatment, polishing, electroplating, and finally, the final inspection. There may also be included a treatment which smoothes the end surfaces of the butts 19.

I claim:

1. A method of manufacturing sewing machine needles from a cylindrical length of wire by compression molding, comprising the steps of providing the length of the wire substantially corresponding to two of the needles to be manufactured and a diameter of the wire corresponding substantially to the thickness of a butt of the needles to be manufactured, said length of the wire being a single piece constituting two coaxial connected needle blanks for the two needles to be manufactured, simultaneously working said two coaxial connected needle blanks to form said two needles, each of said two needles having said butt and a needle shank and a point region at remote ends of the blank and a section between said butt and said shank, with said two coaxial connected needle blanks being worked such that said butts respectively face each other, by the steps of reducing said length of wire constituting said two coaxial connected needle blanks approximately to a final cross-sectional dimension of the needles to be manufactured over ends of said two coaxial connected needle blanks forming said shanks and said sections of the two needles to be manufactured of said two coaxial connected needle blanks, leaving said butts of said two needles facing each other joined back to back, said reducing step further pressing grooves in the wire from transversely convexly curved outer surfaces of the wire within a region of said shanks while simultaneously effecting said reducing of said two coaxial connected needle blanks approximately to said cross-sectional dimension of the needles to be manufactured over said point regions, said shanks and said sections of the two needles by pressing opposite portions of the blanks at said shanks and point regions so as to form laterally projecting flat fins which leave therebetween the transversely convexly curved outer surfaces of reduced diameter substantially corresponding to said final cross-sectional dimension, and removing said flat fins in a subsequent step.

2. The method according to claim 1, wherein end surfaces of said butts are connected and define a common cross-sectional plane of said two coaxial connected needle blanks.

3. The method according to claim 2, further comprising the step of forming a notch in said two coaxial connected needle blanks so as to predetermine said cross-sectional plane prior to said reducing step.

4. The method according to claim 1, wherein said reducing step includes pre-embossing an eye into each of said two needle blanks adjacent free ends of said shanks.

5. The method according to claim 4, further comprising pressing a fillet in said two coaxial connected needle blanks in the region of said eye, respectively, said fillets extending on a side of said needle shanks opposite said grooves.

6. The method according to claim 5, further comprising simultaneously with said pressing of said fillet forming a short groove adjacent said fillet in the region of said pre-embossed eye.

7. The method according to claim 5, wherein said step of pressing said fillet is effected during said step of pressing said grooves during said reducing step.

8. The method according to claim 4, further comprising stamping out said pre-embossed eyes.

9. The method according to claim 8, further comprising dimpling said eyes.

10. The method according to claim 8, further comprising pointing said two coaxial connected needle blanks at the point regions at the remote ends thereof while said butts of said two needles are joined back to back.

11. The method according to claim 1, further comprising cutting and separating said two coaxial connected needle blanks between said butts of said two needles.

12. The method according to claim 1, wherein during said reducing step said butts are simultaneously formed with a flattening.

13. The method according to claim 1, wherein said providing step comprises cutting the wire to said length, corresponding to said two needles to be manufactured, constituting said two coaxial connected needle blanks of one-piece.

14. The method according to claim 1, wherein during said reducing step said sections are formed as frustoconical sections.

15. The method according to claim 1, further comprising pointing said two coaxial connected needle blanks at the point regions at the remote ends thereof while said butts of said two needles are joined back to back simultaneously during said pressing of opposite portions of the blanks in said reducing step.

16. The method according to claim 15, wherein said pointing during the pressing step flattens said point regions into a knife shape.

17. The method according to claim 16, wherein said knife shape forms a wedge shape.

18. The method according to claim 16, wherein subsequentially finally shaping the point regions into finally shaped needle points.

19. The method according to claim 17, wherein said pointing during the pressing step flattens said point regions into a knife shape.

* * * * *